US007467607B2

(12) United States Patent
Jones

(10) Patent No.: US 7,467,607 B2
(45) Date of Patent: Dec. 23, 2008

(54) FREE PISTON VACUUM PRODUCING APPARATUS

(76) Inventor: David Beatty Jones, 12 Austin Ave., San Anselmo, CA (US) 94960

( * ) Notice: Subject to any disclaimer, the term of this patent is extended or adjusted under 35 U.S.C. 154(b) by 2 days.

(21) Appl. No.: 10/319,699

(22) Filed: Dec. 12, 2002

(65) Prior Publication Data

US 2004/0112308 A1 Jun. 17, 2004

(51) Int. Cl.
*F02B 71/00* (2006.01)

(52) U.S. Cl. ..... 123/46 R

(58) Field of Classification Search ..... 123/46 R, 123/46 A, 46 B, 46 SC, 46 E, 46 H
See application file for complete search history.

(56) References Cited

U.S. PATENT DOCUMENTS 168,623 A 11/1875 Daimler
178,023 A 5/1876 Otto
4,399,368 A * 8/1983 Bucknam ..... 290/1 R
4,484,082 A * 11/1984 Bucknam ..... 290/1 R
4,491,095 A * 1/1985 Coad ..... 123/46 R
5,144,917 A * 9/1992 Hammett ..... 123/46 SC
6,213,097 B1 * 4/2001 Maucher ..... 123/46 SC

* cited by examiner

*Primary Examiner*—Stephen K Cronin
*Assistant Examiner*—Hyder Ali
(74) *Attorney, Agent, or Firm*—Steven A. Nielsen; Allman & Nielsen, P.C.

(57) ABSTRACT

The free piston vacuum producing apparatus is an internal combustion device with no piston rod or constraining mechanism attached to the free piston. After fuel ignition the piston is rapidly propelled toward the open end of a cylinder. As the combustion gases expand, the piston's momentum propels it past the point where the pressure is equal on both sides of the piston. A vacuum is created in the cylinder behind the piston. When the piston comes to a stop, the vacuum in the cylinder is secured. An air/gas/vapor entry port into the cylinder is then opened to allow outside air, gas, or vapors to enter the cylinder. The gases drawn into the cylinder's vacuum pass through a device, such as a turbine, in order to produce work or energy from the flowing gases. The cylinder's vacuum can thus be used as the basis for vacuum pumps, evaporators, or gas evacuation device.

25 Claims, 5 Drawing Sheets

FREE PISTON VACUUM PRODUCING APPARATUS

BACKGROUND OF THE INVENTION

This invention relates to an internal combustion piston-cylinder apparatus where the movement of a free piston is used to create a vacuum in a cylinder and where outside air, gases, or vapors are subsequently allowed to enter the cylinder's vacuum through a device that produces work or energy from the flowing gases.

Free piston engines are well known and include single chambers with one piston, single chambers with multiple pistons, and pistons in separate chambers coupled together with rods or other mechanical devices. The majority of free piston internal combustion apparatuses are used to compress a gas. Another common use of free piston devices is to directly power an engine.

A very basic example of a free piston in one chamber is U.S. Pat. No. 727,067 (Blake and Bell, 1903). The free piston is propelled up a vertical cylinder in order to compress a gas. A more complex example of a free piston device with multiple chambers is illustrated in U.S. Pat. No. 1,571,615 (Babin, 1926). The purpose of this device is also to compress a gas. During a portion of this device's operating cycle the movement of the piston causes a partial vacuum in the cylinder. The vacuum is used to suck gas into the cylinder so that it can be compressed. These inventions represent early prototypes of free piston devices.

Hundreds of free piston devices using one or two pistons in a cylinder to compress a gas have been patented since 1900.

Four inventors between 1863 and 1876 experimented with a different type of free piston device. These devices all used a free piston to create a vacuum in a cylinder. The pressure difference between the atmosphere and the cylinder's vacuum was then used to pull a second piston into the cylinder's vacuum in order to power an engine.

British patent 2,098 (R. A. Brooman, 1863) shows a gas engine where the up stroke of a piston is performed by an explosion in a cylinder. The piston travels sufficiently far to create a vacuum in the cylinder. A second piston is subsequently pulled into the cylinder's vacuum by outside air pressure. The second piston has a piston rod attached to it. An elaborate mechanism is used to convert the up and down motion of the second piston into the rotary motion of an engine.

British patent 1,173 (F. W. Wenham, 1864) shows a gas engine consisting of two pistons in a cylinder with both ends open to the atmosphere. The first piston has a piston rod on it that is connected to a crank shaft. The second piston is driven by a gas explosion to the opposite end of the cylinder and travels sufficiently far to form a vacuum in the cylinder. The vacuum is secured by holding the second piston in place where it stops. The piston holding mechanism consists of driving two wedges driven against a flat rod connected to the second piston. The first piston is then sucked into the cylinder's vacuum, turning a crack shaft for an engine. In this device mechanisms are also needed to translate the up and down motion of the piston into the rotary motion needed for an engine.

U.S. Pat. No. 168,623 (Daimler, 1875) describes an apparatus where a fuel/air mixture is ignited in a cylinder to propel a free piston to the point where the expansion and cooling of combustion products create a partial vacuum in the cylinder. The free piston is fitted with loose conical rings connected to springs that allow the piston to become wedged into a conical section at the upper end of the cylinder. By using this piston holding mechanism, a vacuum is secured in the cylinder. A second loose piston with a piston rod attached to it is then pulled into the cylinder's vacuum in order to power an engine.

In U.S. Pat. No. 178,023 (Otto, 1876) a free piston is driven to one end of a cylinder by an explosion so that the products of the explosion cool and condense and create a partial vacuum in the cylinder. A second piston is then forced into the cylinder by the atmospheric pressure. The second piston is connected to cranks on a fly wheel shaft.

The free piston devices of Wenham, Brooman, Daimler, and Otto all use the vacuum created in a cylinder to pull a piston with a rod connected to it into a cylinder. None of these apparatuses utilizes the vacuum that is created in the cylinder as a basis for a vacuum pump, evaporator, or gas evacuation device. None of the apparatuses allows air, gas, or vapors from outside the cylinder to enter the cylinder's vacuum in order to produce work or energy from the gases flowing into the cylinder's vacuum. All of these inventions needed cumbersome mechanisms to translate the pistons up and down motion into rotary motion. Because of the drawbacks inherent in these mechanisms, there is little evidence that these or other inventors pursued the concept of creating a vacuum in a cylinder to drive an engine after 1876.

In addition to the above patents, there are a few other examples where a free piston is stopped and held in place after a combustion gas expansion. In U.S. Pat. No. 4,491,095 (Feinberg, 1995) a free piston engine includes a mechanism to restrain a piston and hold in place as part of an engine cycle. This mechanism that grabs hold of the piston when its velocity goes to zero. The piston holding mechanism is a three jawed collet supported by needle bearings on tapered ways. This mechanism is released by a solenoid having a short stroke with a high force. The purpose of the holding mechanism is to provide a variable dwell between each cycle. The purpose of holding the piston is not to create a vacuum in a cylinder.

In U.S. Pat. No. 5,144,917 (Hammett, 1992) a free piston is restrained during an engine cycle. Hooked detents are situated at each end of the cylinder to catch and hold the piston in a fixed position during a portion of the combustion cycle. The purpose of this device, however, is to compress gas, not to create a vacuum in a cylinder.

U.S. Pat. No. 4,399,368 (Bucknam, 1983) depicts an apparatus that restrains a free piston after a gas expansion cycle in order to create a partial vacuum in a cylinder. Liquid at the bottom of a cylinder is heated using a solar beam to vaporize the liquid. The vapor pushes a piston up a vertical cylinder. The piston is held in place and the vapor is allowed to condense and form a vacuum below the piston. The piston is then released and pulled into the cylinder's vacuum to generate an electric current. This device, however, does not use an internal combustion process. Its does not allow air, gas, or vapors to flow into the cylinder as a means to produce work or energy.

One of the most common devices to create a vacuum for industrial evaporators or gas evacuation equipment is a steam jet ejector. Steam jet ejectors have few moving parts, but their energy efficiency is very low. Steam jet ejectors use high pressure steam rather than an internal combustion process to create a vacuum.

BRIEF SUMMARY OF THE INVENTION

The free piston vacuum producing apparatus is an internal combustion device with no piston rod or constraining mechanism attached to the piston. The piston is in a cylinder with one end open to the atmosphere. After fuel ignition, the expanding combustion gases behind the piston propel it past the point where the pressure is equal on both sides of the piston. The combustion gas pressure behind the piston drops rapidly as the piston moves forward, creating a vacuum in the cylinder. The cylinder is sufficiently long to allow the piston to travel to the point where its velocity goes to zero and it comes to rest. When the piston comes to a stop, the vacuum in the cylinder is secured either by holding the piston in place or by sealing the open end of the cylinder. An entry port into the cylinder is then opened to allow outside air, gas, or vapors to enter the cylinder. Connected to the entry port is a device, such as a turbine, that produces work from the air, gas, or vapor that flows into the cylinder's vacuum. The free piston vacuum producing apparatus can form the basis for gas vacuum pumps, gas evacuating devices, or evaporators. The apparatus can also be used to power devices that produce work or energy from the gases that flow into the cylinder.

The free piston apparatus of the present invention differs from prior art in that the free piston is allowed to travel as far as its momentum will carry it in order to create a vacuum inside a cylinder. The cylinder's vacuum is not used to pull a piston into it in order to power an engine. Nor is the cylinder's vacuum used to draw air or an air/fuel mixture into the cylinder as part of an engine's combustion cycle. Rather the cylinder's vacuum is used to pull outside air, gas, or vapors into the cylinder through an entry port in the cylinder. By passing the gases that flow into the cylinder through a device, such as a turbine, the work produced from the flowing gases is converted directly into the rotational energy of the turbine shaft. This avoids complicated mechanisms to convert the up and down motion of a piston to the rotational motion of a drive shaft.

Accordingly, several objects and advantages of my invention are:

(a) To create a vacuum in a cylinder in a very energy efficient manner (b) To utilize the cylinder's vacuum as a basis for vacuum pumps, evaporators, or gas evacuating devices that are more energy efficient than conventional vacuum pumps or steam jet ejectors.

(c) To utilize the cylinder's vacuum as a basis for devices, such as a turbine, that produce work or energy from the air, gas, or vapor flowing into the cylinder's vacuum.

(d) To utilize the cylinder's vacuum as a basis for devices that pump fluids in a more energy efficient manner than conventional pumps.

(e) To drive a shaft for turbines, engines, pumps, compressors, or machinery with an apparatus that:

Is more fuel efficient than a conventional internal combustion engine

Uses fewer moving parts than conventional internal combustion engines

Does not require cooling water or a cooling water circulation system

Further objects and advantages of my invention will become apparent from a consideration of the drawings and ensuing descriptions.

BRIEF DESCRIPTION OF THE DRAWING

The following figures show drawings of different embodiments of the free piston vacuum producing apparatus.

REFERENCE NUMERALS IN DRAWINGS

Figure 1A:
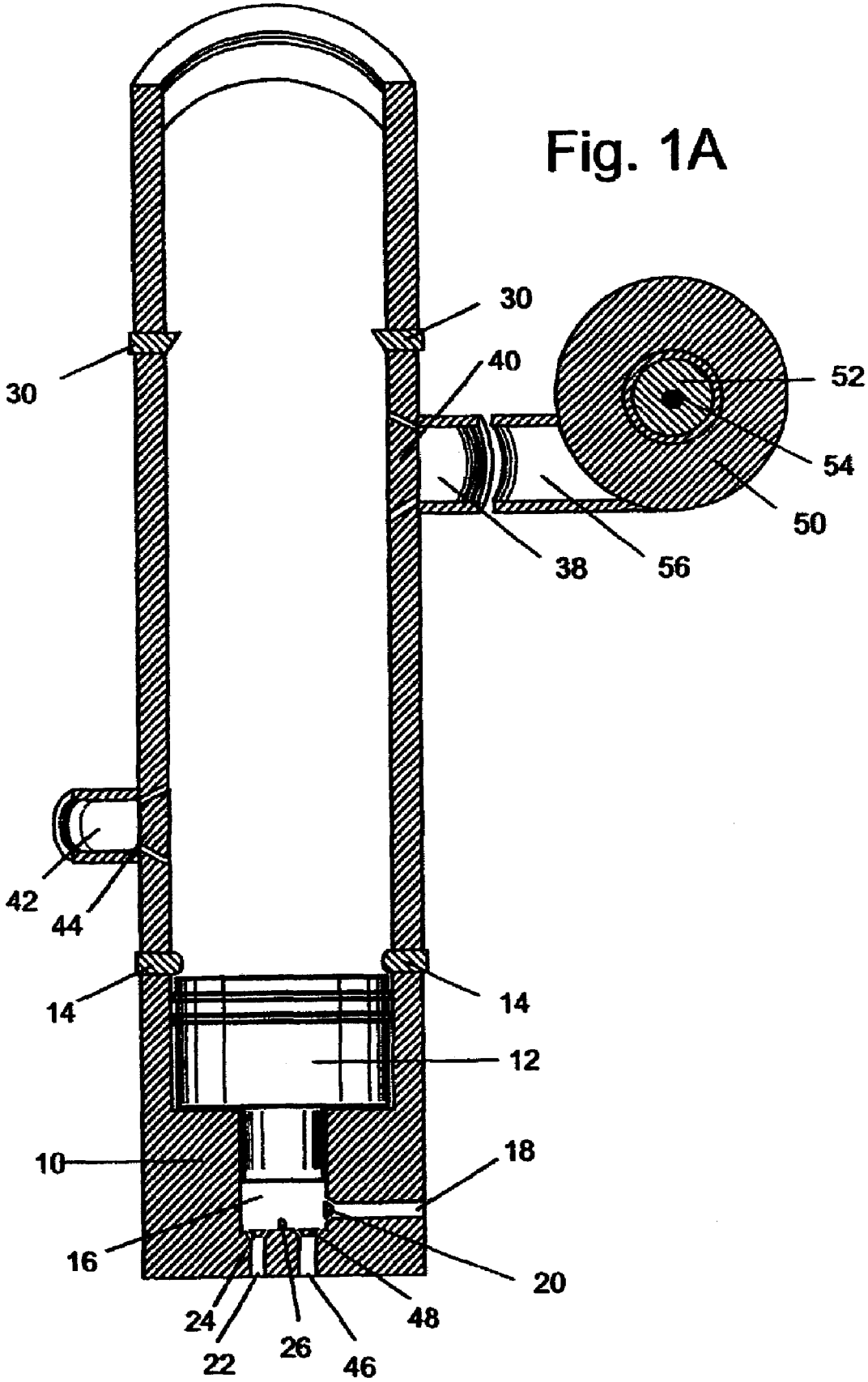
FIGS. 1A and 1B shows Embodiment 1 with the cylinder open to the atmosphere and an air/gas/vapor entry port located below the point where the piston stops.

10 Cylinder
42 Exhaust port
12 Free Piston
44 Exhaust port valve
14 Piston holding mechanism
46 Exhaust port
16 Combustion chamber
48 Exhaust port valve
18 Air/fuel entry port
50 Turbine
20 Air/fuel entry port valve
52 Turbine air/gas/vapor intake
22 Fuel injection line
54 Turbine shaft
24 Fuel injection line valve
56 Turbine air/gas/vapor exhaust
26 Fuel ignition device
72 Lower piston
30 Piston holding mechanism
74 Lower piston extension rod
32 Cylinder sealing device
76 Lower piston strike plate
34 Energy-absorbing device
78 Upper piston casing
36 Upper cylinder clearance volume
70 Two-part piston
38 Air/gas/vapor entry port
80 Piston guide struts
40 Air/gas/vapor entry valve
82 Tension device

DETAILED DESCRIPTION OF THE INVENTION

Physical Components

Discussed below are detailed descriptions of the physical components of the invention. Embodiment 3 is the preferred embodiment. Embodiment 1 and 2 are discussed first in order to introduce the invention in its most simplified form.

Embodiment 1

Air/Gas/Vapor Entry Port Below Piston Stopping Point

Figure 1B:
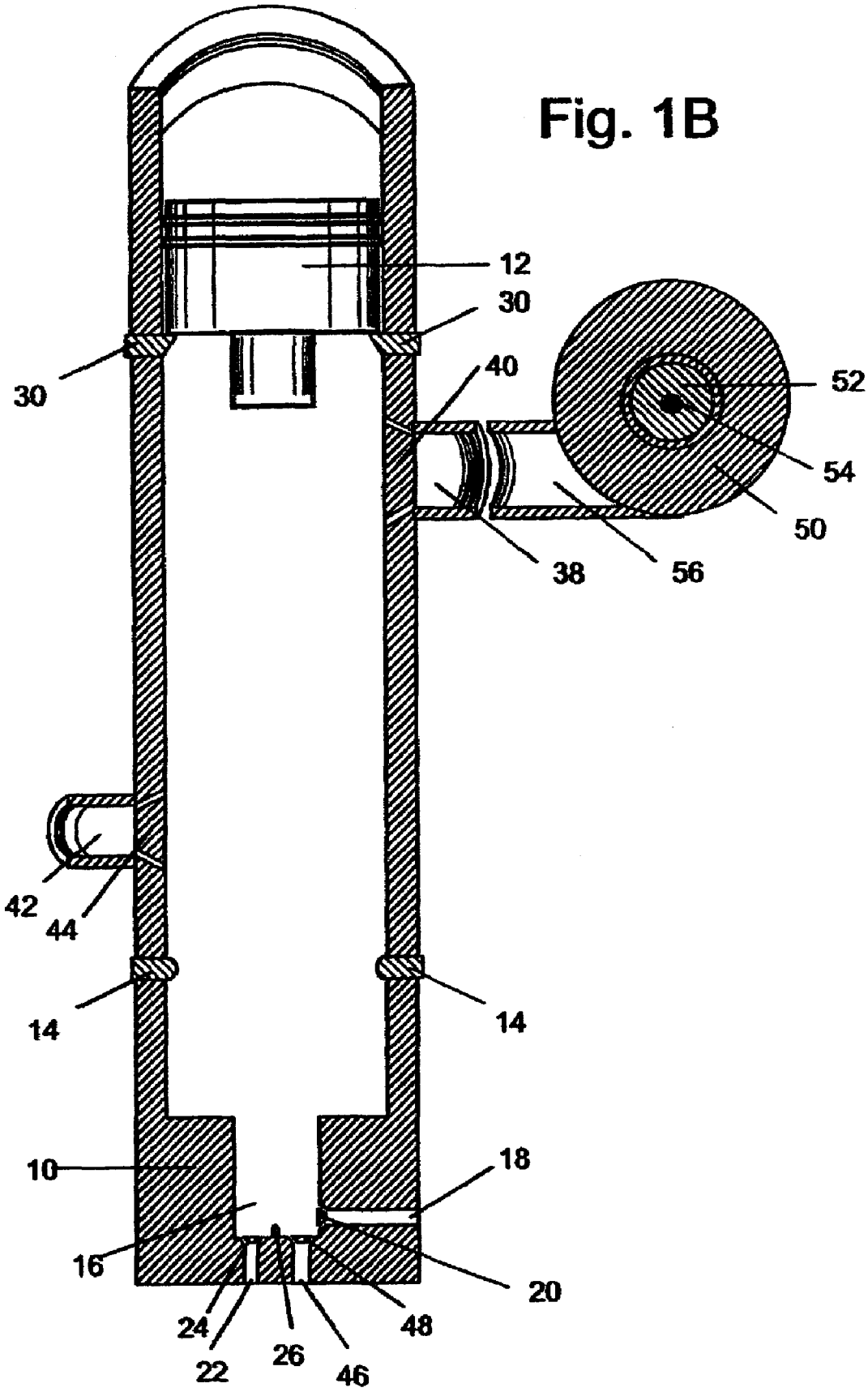

Embodiment 1 is illustrated in FIGS. 1A and 1B. It comprises a cylinder 10 positioned vertically. A free piston 12 is initially positioned at the bottom of the cylinder. The cylinder wall is of sufficient thickness to withstand the pressure generated by fuel combustion, and may be tapered such that the wall is thicker at the bottom. The cylinder is of sufficient length to allow the combustion gas expansion to propel the piston to a point where a vacuum will be created behind the piston.

A piston holding mechanism 14 is located at the bottom end of the cylinder to secure the piston in place until a fuel/air mixture is ignited. A combustion chamber 16 for the fuel/air mixture explosion is located at the base end of the cylinder.

The combustion chamber volume is calculated as a function of the power to be produced for each fuel ignition explosion and of the properties of the combustible mixture employed. An air/fuel entry port 18 leads into the combustion chamber through an air/fuel entry valve 20. A fuel ignition device 26 is located in the combustion chamber. As an alternative method for charging the combustion chamber with fuel, a fuel injection line 22 with a fuel injection line valve 24 is shown at the bottom end of the cylinder.

A piston holding mechanism is located at the upper end of the cylinder 30 to secure the piston in place where it comes to rest after combustion gas expansion. An air/gas/vapor entry port 38 provides an opening in the cylinder wall through an air/gas/vapor entry valve 40. An exhaust port 42 provides an opening in the cylinder wall through an exhaust port valve 44. An additional exhaust port 46 provides an opening in the cylinder base through an exhaust port valve 48. A turbine 50 with an air/gas/vapor intake 52, a rotating shaft 54, and an air/gas/vapor exhaust 56 is connected to the air/gas/vapor entry port.

Embodiment 2

Air/Gas/Vapor Gas Entry Port Below Piston Stopping Point with Cylinder Seal

Figure 2:
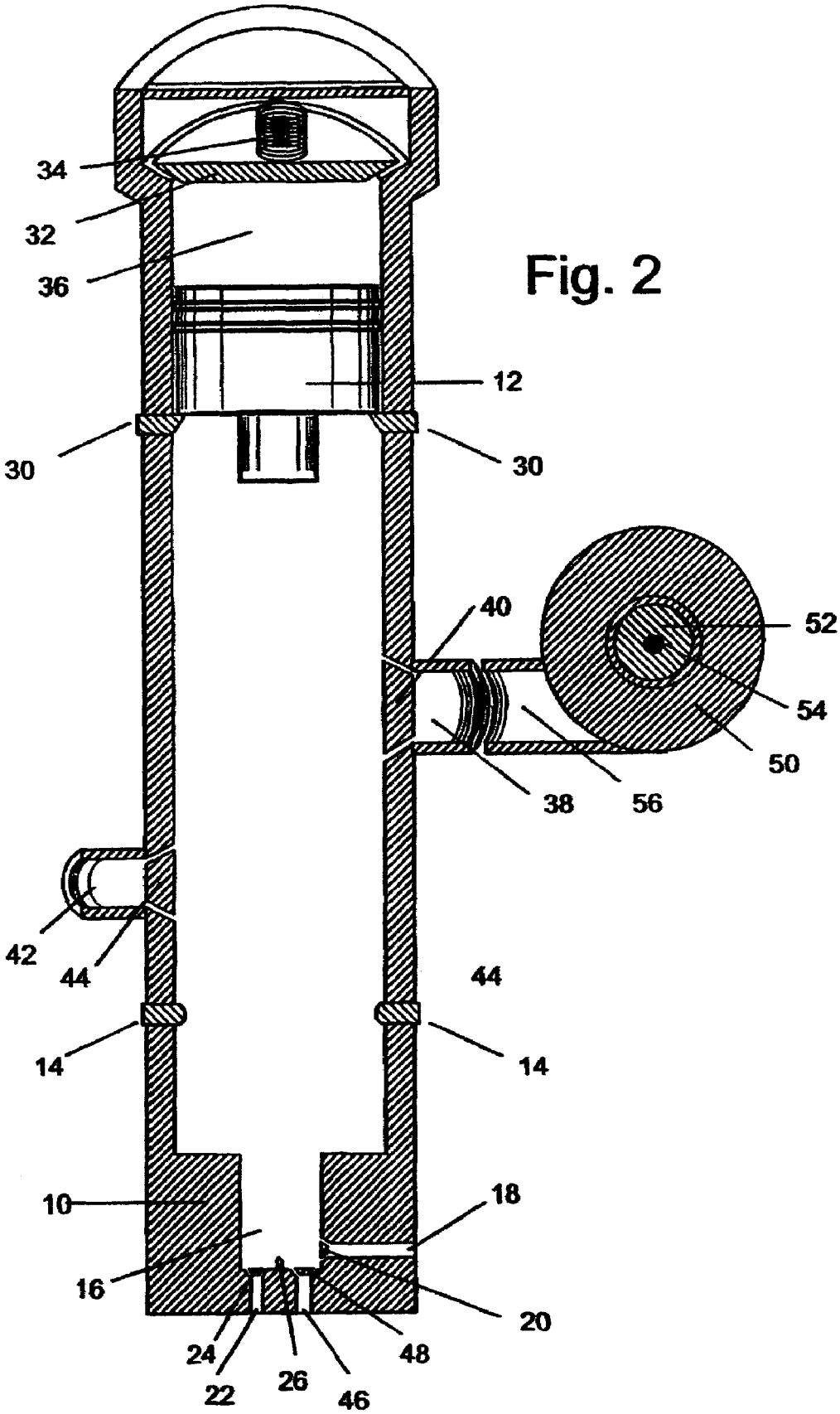
FIG. 2 shows Embodiment 2 with a cylinder a sealing device at the top of the cylinder and an air/gas/vapor entry port located below the point where the piston stops.

Embodiment 2 is illustrated in FIG. 2. The apparatus is the same as shown in Embodiment 1 except that a cylinder sealing device 32 is located at the top end of the cylinder and an energy-absorbing device 34 is located above the cylinder sealing device. An upper cylinder clearance volume 36 is formed in the space above the piston and below the cylinder sealing device.

Embodiment 3

Air/Gas/Vapor Gas Entry Port Above Piston Stopping Point with Cylinder Seal

Figure 3:
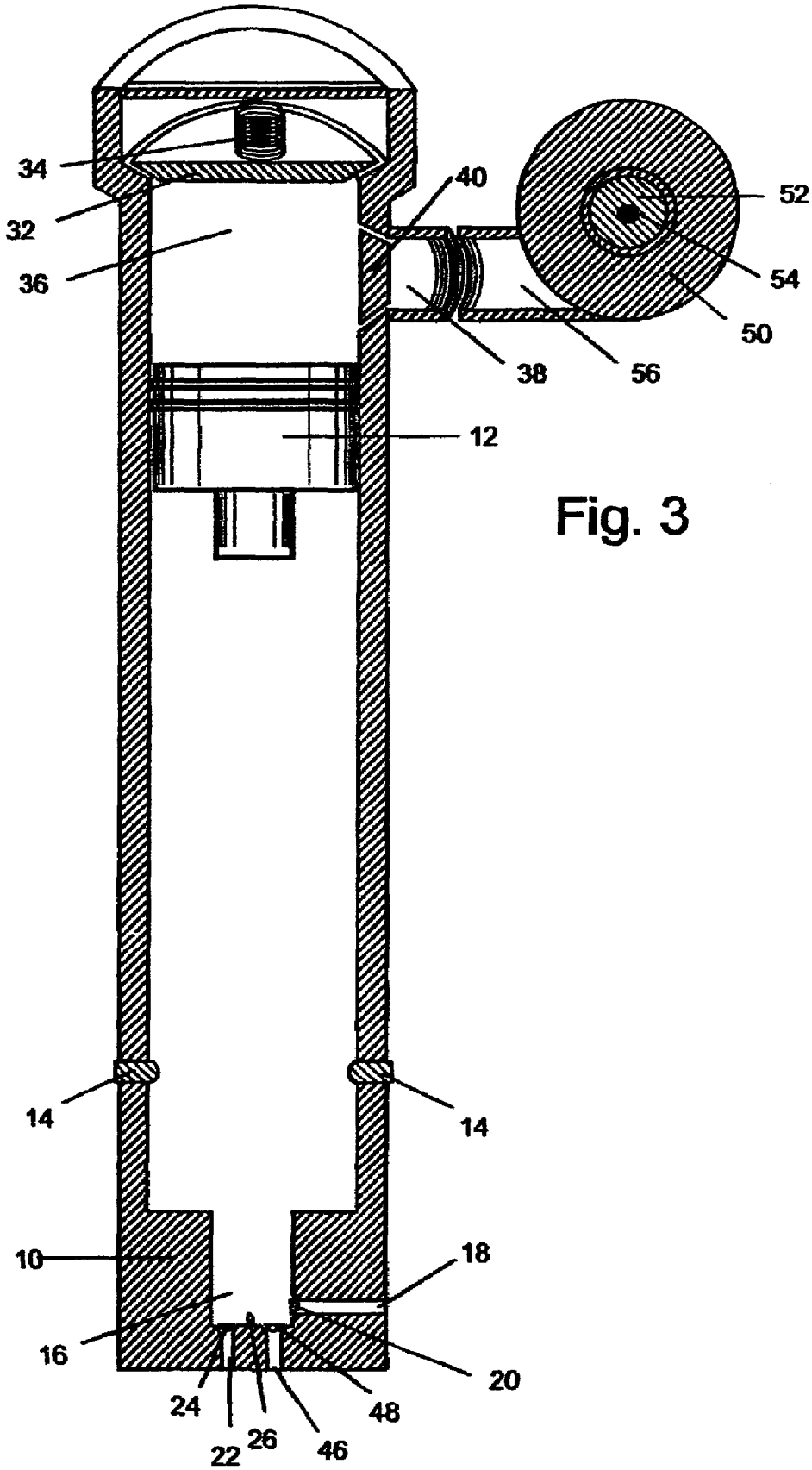
FIG. 3 shows Embodiment 3 with a cylinder sealing device at the top of the cylinder and an air/gas/vapor entry port located above the point where the piston stops.

Embodiment 3 is illustrated in FIG. 3. The apparatus is the same as shown in Embodiment 2 except that an air/gas/vapor entry port 38 and an air/gas/vapor entry port valve 40 are located above the point where the piston stops. Also, the piston holding mechanism at the top of the cylinder 30, the exhaust port 42, and exhaust port valve 44 have been eliminated.

Embodiment 4

Two-Part Piston

Figure 4A:
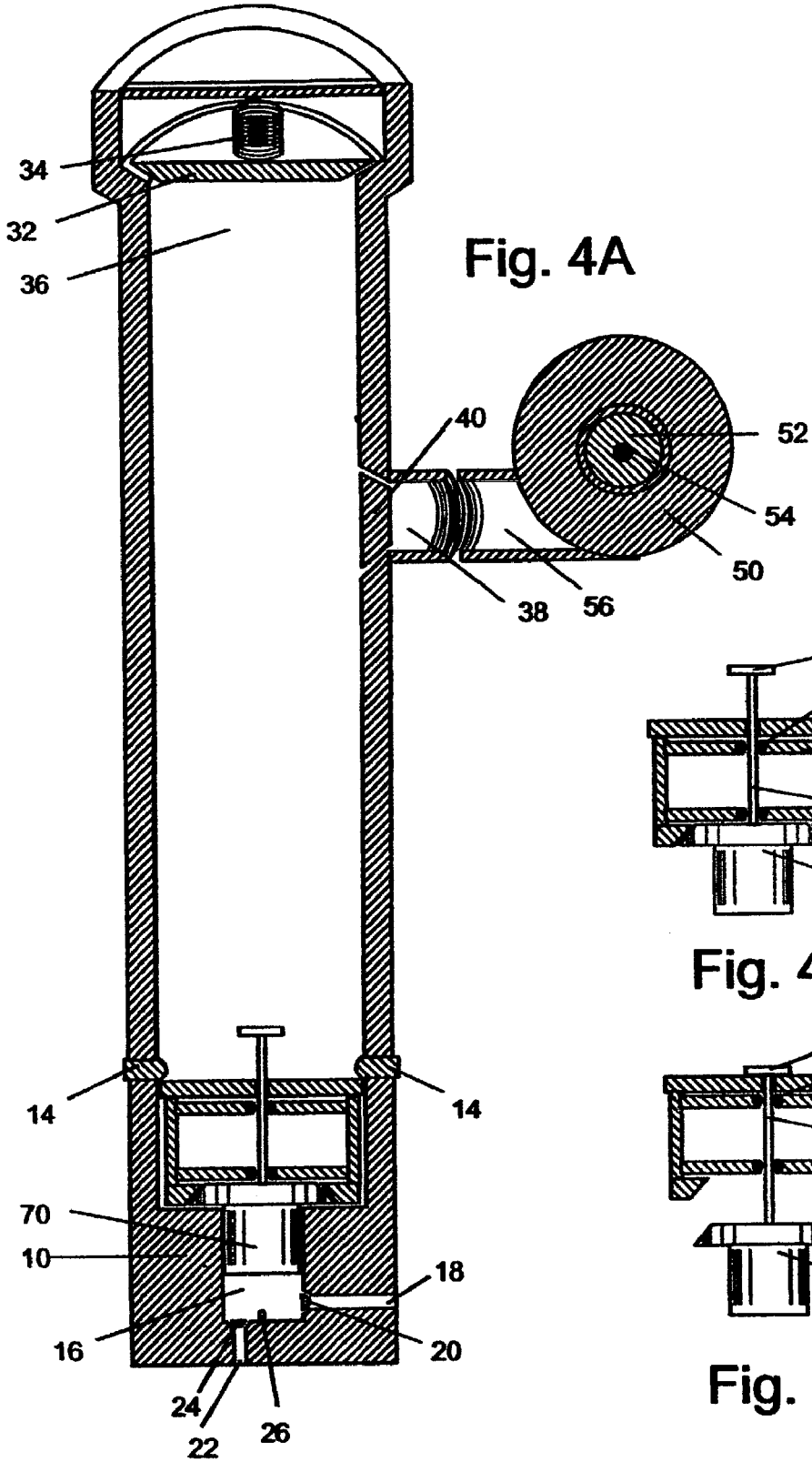
FIGS. 4A, 4B, and 4C show Embodiment 4 with a cylinder sealing device, an air/gas/vapor entry port located below the point where the piston stops, and a two-part piston.
Figure 4B:
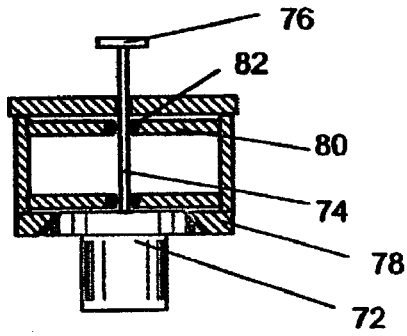
Figure 4C:
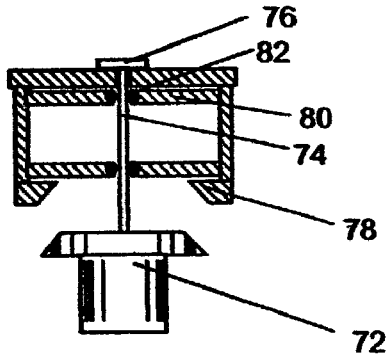

Embodiment 4 is illustrated in FIGS. 4A-4C. The apparatus is the same as shown in Embodiment 3 except that a two-part piston 70 is used in the cylinder and the exhaust port 46 and exhaust port valve 48 have been eliminated.

FIGS. 4B, and 4C show the two-part piston used in Embodiment 4. FIG. 4A shows the two-part piston at the bottom of the cylinder. The piston is designed to allow combustion gases to flow through the piston during the piston's downward movement. FIG. 4B shows the piston in its initial closed position with a lower piston 72 abutting an upper piston casing 78. The upper piston casing is hollow in the center to allow air to flow through it. A lower piston extension rod 74 has a strike plate 76 at its upper end. The lower piston extension rod is held in place by piston guide struts 80 attached to the upper piston casing. Tension devices 82 mounted on the piston guide struts hold the lower piston extension rod in place. FIG. 4C shows the piston in its open position where the lower piston is detached from the open piston. In this position a path is opened for combustion gases to pass through the hollow core of the upper piston.

DETAILED DESCRIPTION OF THE INVENTION

Operation

Discussed below are detailed descriptions of the operation of the invention. Embodiment 3 is the preferred embodiment. Embodiment 1 and 2 are discussed first in order to introduce the invention in its most simplified form.

Embodiment 1

Open Cylinder: Air/Gas/Vapor Entry Port Below Piston Stopping Point

The free piston vacuum producing apparatus is illustrated in FIG. 1A. The free piston 12 is initially positioned in the bottom of a vertical cylinder. A combustion chamber 16 for the fuel/air mixture explosion is located at the bottom end of the cylinder. While the piston is still held in its initial position by the piston holding mechanism 14, an air/fuel mixture valve 20 is opened and a mixture of compressed air and fuel is allowed to enter the combustion chamber through an air/fuel entry port 18. The pressure of the fuel/air mixture and the fuel/air ratio is calculated such that the expansion of combustion gases will propel the piston sufficiently far in the cylinder to create a partial vacuum behind the piston when the piston comes to rest. Once the combustion chamber is filled with a fuel/air mixture at the proper pressure, the air/fuel mixture valve is closed.

The fuel ignition device 26 is activated to ignite the fuel/air mixture. At the same instant the fuel is ignited, the piston holding mechanism is triggered to release the piston. The high pressure of the combustion gases behind the piston propels it vertically up the cylinder past the point where the pressure is equal on both sides of the piston. The pressure behind the piston drops rapidly as the piston moves upward, creating a vacuum behind the piston. The distance at which the piston's velocity will become zero is calculated based on the fuel/air ratio, fuel/air mixture pressure, piston friction, and other relevant factors. A piston holding mechanism 30 is placed at a position where it has been determined that the piston velocity will become zero and the piston will come to rest. The piston's momentum propels it up the cylinder until it reaches the piston holding mechanism. The piston holding mechanism is then triggered to hold the piston in place when the piston comes to rest. By holding the piston in place, the top of the cylinder is sealed from the atmosphere and the vacuum inside the cylinder is secured. FIG. 1B shows the piston in the position where it comes to rest.

All operations to this point have been designed to achieve a partial vacuum in the cylinder. Once the vacuum in the cylinder is secured, a pressure difference has been created between the combustion gases in the cylinder and air or gases outside the cylinder. An air/gas/vapor entry valve 40 is then opened to allow air, gases, or vapors to flow into the cylinder's vacuum through an air/gas/vapor entry port 38 in the cylinder wall. The gases that are sucked into the cylinder's vacuum go through a device to produce work or energy from the flowing gases. For this embodiment this device is a turbine 50 that is connected to the cylinder air/gas/vapor entry port. The air, gases, or vapors that come through the turbine's intake 52 cause the turbine's shaft 54 to rotate. Work or energy is produced from the rotational energy of the turbine's shaft. The air, gases, or vapors exit through the turbine air/gas/vapor exhaust 56 and go into the cylinder's entry port. Different combinations of air, gases, or vapors may enter the cylinder through the turbine either sequentially or simultaneously. For instance, vapor from an industrial evaporator may enter the turbine until the absolute pressure inside the cylinder reaches a predetermined value. Air may subsequently be allowed to enter the turbine in order to produce additional work or energy from the pressure difference between the atmosphere and the cylinder's vacuum.

Once the vacuum inside the cylinder has been utilized the piston holding mechanism 30 is triggered to release the piston. Gravity propels the piston back to its initial starting position after the piston is released. Exhaust port valves 44 and 48 are opened to allow the combustion products to exit the cylinder through exhaust ports 42 and 46. When the piston reaches the bottom of the cylinder the piston holding mechanism 14 is activated to hold the piston in place and the exhaust port valves are closed. The air/gas/vapor entry port valve is then closed. The apparatus is now ready to begin another cycle.

Embodiment 2

Cylinder Seal: Air/Gas/Vapor Entry Port Below Piston Stopping Point

FIG. 2 shows the position of the piston where it comes to rest at the end of the combustion gas expansion for embodiment 2.

The operation of Embodiment 2 is identical to that of Embodiment 1 up to the release of the piston after fuel ignition. At the time of fuel ignition the cylinder sealing device at the top of the cylinder is in a closed position and a pocket of air at atmospheric pressure is contained in the space between the top of the piston and the piston sealing device. The operating parameters of the cylinder sealing device are set so that the top of the cylinder will become open to the atmosphere at a predetermined pressure. For this embodiment the predetermined pressure would normally be slightly above one atmosphere.

After the piston is released, the high pressure of the combustion gases behind the piston propels it vertically up the cylinder. The air in the space above the free piston will be pushed upward and compressed. The compressed air above the piston will cause the piston sealing device to open when the air pressure reaches the predetermined level. The pressure behind the piston will continue to drop rapidly as the piston moves forward, creating a vacuum behind the piston. The piston's velocity approaches zero as it nears the top of the cylinder. At this point the air pressure above the piston will fall and the piston sealing device at the top of the cylinder will close. When it comes to rest, the piston holding mechanism 30 is triggered to secure the piston.

The upper cylinder clearance volume 36 will contain compressed air at the predetermined pressure. The compressed air pocket in the upper cylinder clearance volume and the energy-absorbing device act as a cushion and shock absorber in the case that the explosive charge of the fuel/air mixture is greater than expected and the piston travels a greater distance than anticipated.

Once the cylinder's vacuum has been secured, the air/gas/vapors entry port valve is opened as described in Embodiment 1 and gases are allowed to enter the cylinder's vacuum through a turbine. Once the vacuum inside the cylinder has been utilized, the piston holding mechanism is triggered to release the piston. Gravity and the pressure of the compressed air pocket above the piston propel the piston back to its initial starting position after the piston is released. The remaining operations are identical to Embodiment 1.

Embodiment 3

Cylinder Seal: Air/Gas/Vapor Entry Port Above Piston Stopping Point

FIG. 3 shows the position of the piston where it comes to rest at the end of the combustion gas expansion for embodiment 3.

For embodiment 3, all of the operations described in embodiment 2 are identical up to point where the piston has come to rest and the cylinder sealing device has secured the cylinder's vacuum. After the cylinder has been sealed, air, gas, or vapors are allowed to enter the cylinder's vacuum through an entry port and turbine as described in Embodiment 1. As gases enter the cylinder the free piston will be pushed back to its initial position at the bottom of the cylinder by the force of gravity and by the pressure difference between the incoming air, gas, or vapor above the piston and the partial vacuum below the piston.

In Embodiment 3, the piston is propelled back to its initial position at the same time air, gas, or vapors are entering the cylinder. As the piston nears the bottom of the cylinder, an exhaust port valve 48 is opened to allow the combustion products to exit the cylinder through an exhaust port 46. The piston's downward momentum and the force of gravity pull the piston back to its initial position. When the piston reaches the bottom of the cylinder the piston holding mechanism 14 is activated to hold the piston in place and the exhaust port valve is closed. The air/gas/vapor entry port valve is then closed. The apparatus is now ready to begin another cycle.

Embodiment 4

Cylinder Seal: Two-Part Piston

FIGS. 4A, 4B, and 4C illustrate an alternative embodiment where a two-part piston 70 is used. FIG. 4A shows the piston as it is configured at the bottom of the cylinder.

Upon fuel ignition the force of the combustion gas expansion will force the lower piston 72 to stay abutted to the upper piston casing 78 as the piston is propelled up the cylinder. This piston configuration is illustrated in FIG. 4B. For this embodiment the operation of the apparatus is the same as described in Embodiment 3 up to the point where the piston approaches the top of this cylinder near the end of the combustion gas expansion.

As the piston's velocity approaches zero, the pressure above the piston will fall to the predetermined level that triggers the piston sealing device to seal the top of the cylinder. The piston's final upward momentum will cause the lower piston strike plate 76 hits the top of the cylinder. The impact of the strike plate causes the lower piston extension rod 74 to slide through the piston guide struts 80. This action causes the piston to become configured in an open position that allows the combustion gases to flow through it. This configuration is illustrated in FIG. 4C. The tension devices 82 on the piston guide struts act to hold the piston in this open configuration. In this open position the piston, the piston will immediately begin to fall to the bottom of the cylinder.

Once the cylinder has been sealed, air, gas, or vapor is allowed to enter the cylinder's vacuum through an entry port and turbine as described in Embodiment 3. Once the cylinder's vacuum has been utilized, the air/gas/vapor entry port valve is then closed. The piston is pulled by gravity to its initial position as gases enter the cylinder. When the bottom of the two-part piston hits the bottom of the cylinder the impact will force the piston extension rod to slide through the piston guide struts until the piston is reconfigured to the closed position illustrated in FIG. 4B. When the upper piston casing hits the bottom of the cylinder, the piston holding mechanism 14 is activated to hold the piston in place. The apparatus is now ready to begin another cycle.

Alternative Embodiment

No Device to Produce Work or Energy

An alternative embodiment of the free piston vacuum producing apparatus is to operate in a manner such that all or a portion the air, gases, or vapors that enter the air/gas/vapor entry port 38 flow directly into the cylinder without first passing through a turbine or other device to produce work or energy from the gases flowing into the cylinder's vacuum. This alternative could be used for any embodiment.

Alternative Embodiment

Fuel Injection

All embodiments for free piston vacuum producing apparatus can be operated in a fuel injection mode. This operation is illustrated in FIG. 1. In this embodiment the air/fuel entry port 18 is used for air only. Valve 20 is opened to allow compressed air into the piston clearance volume through the entry port. The entry port valve is closed and a fuel injection line valve 24 is opened to allow fuel to be injected through a fuel injection line 22. Once the predetermined amount of fuel is injected, the fuel injection line valve 24 is closed. The piston holding mechanism 14 is set to release the piston upon fuel ignition. The remaining operation of the apparatus is identical to that for each of the previously described embodiments.

DETAILED DESCRIPTION OF THE INVENTION

Advantages and Conclusion

The free piston vacuum producing apparatus of this invention can be used to create a vacuum in a cylinder in a very energy efficient manner. By opening an air/gas/vapor entry port into the cylinder, the cylinder's vacuum can be used as the basis for basis for vacuum pumps, evaporators, or gas evacuating devices that are more energy efficient than conventional vacuum pumps or steam jet ejectors. The cylinder's vacuum can also be used as the basis for devices that produce work or energy from the air, gas, or vapor flowing into the cylinder's vacuum.

From the description above, a number of advantages of the free piston vacuum producing apparatus become evident:

(a) Because the free piston has no piston rod to restrict its movement, there is great flexibility to operate the apparatus to operating at different fuel mixture pressures, temperature, cylinder lengths and diameter, and piston weights.

(b) One can calculate operating parameters such that almost all of the energy of the air/fuel mixture explosion is used to create a vacuum inside the cylinder and no fuel energy is lost to the atmosphere as waste heat. A vacuum can thus be created with greater fuel efficiency than that of conventional vacuum producing apparatuses.

(c) The rotational energy of the turbine shaft that is turned by the air, gas, or vapor entering the cylinder can act as the power source for engines, pumps, compressors, electrical energy generators, or machinery (d) The small number of moving parts in the apparatus and the absence of complex gears, rods, levers, and interconnected parts will facilitate simple operation with minimal friction and mechanical losses.

(e) Allowing the free piston to travel as far as it is propelled means that the time for combustion gas expansion will be much longer than that of conventional internal combustion engines. There will therefore be more time for complete burning of the fuel. More complete fuel burning will result in greater fuel efficiency.

(f) Allowing the free piston to travel as far as it is propelled means that the temperature in the cylinder at the end of gas expansion will be much lower than that in the cylinder of a conventional internal combustion engine. For many operating conditions this means that the free piston vacuum producing apparatus can operate without cooling water. This also precludes the need for the cooling water circulation systems needed in conventional internal combustion engines.

(g) A number of cylinders can be arrayed such that devices that produce work or energy from each cylinder act in a coordinated manner to drive a common shaft.

The advantage of Embodiment 1 is the simplest form of operation. The advantage of Embodiment 2 is that there is an energy-absorbing device and air cushion to act as a shock absorber if the fuel explosion propels the piston further than expected. In addition, the pressure of the air cushion helps push the piston back to its initial position more quickly. The advantage of Embodiment 3 is that the piston is pushed back to its initial position by the gases that come into the cylinder, thus reducing the time necessary for the piston to get back to its initial position. The advantage of Embodiment 4 is that piston can return to its initial position as gases are entering the cylinder. Another advantage is there is no need for a combustion gas port.

Although the descriptions of the above embodiments contain many specific details, these should not be construed as limiting the scope of the invention but as merely providing illustrations of some of the presently preferred embodiments of this invention. For example, a variety of locations could be used for compressed air entry, fuel mixture entry, air/gas/vapor entry, combustion product exhaust, cylinder sealing device, or features commonly associated with internal combustion devices.

Thus the scope of the invention should be determined by the appended claims and their legal equivalents, rather than by the examples given.

What is claimed is:

1. A method for creating and utilizing a vacuum comprising:

providing a combustion chamber and a cylinder in communication with the combustion chamber, the cylinder having a first portion and a second portion;

positioning a piston in the cylinder first portion;

igniting a combustible material in the combustion chamber and driving the piston toward the cylinder second portion;

creating a vacuum in the cylinder first portion;

exposing a higher pressure working fluid to the vacuum in the cylinder causing the working fluid to flow into the cylinder; and wherein the working fluid flows into the cylinder producing work driving an external apparatus selected from the group comprising a turbine, vacuum pump, evaporator, gas evacuation device, or energy producing device with the flowing working fluid prior to the fluid entering the cylinder.

2. A free-piston internal combustion engine comprising:

a combustion chamber;

a cylinder having a first portion in communication with the combustion chamber, and a distal second portion;

a piston in the cylinder, the piston slidable from a first position in the first portion of the cylinder to a second position in the second portion of the cylinder responsive to ignition of a combustible material in the combustion chamber;

the piston sealingly engaged with the cylinder and operable between the first and second positions to generate a vacuum in the cylinder first portion; and, a conduit in communication with the first portion of the cylinder and with a working fluid at a pressure higher than a vacuum generated in the cylinder first portion, the conduit further communication with an external work producing apparatus producing work selected from the group comprising a turbine, vacuum pump, evaporator, gas evacuation device, or energy producing device.

3. A free-piston internal combustion engine according to claim 2 further comprising a piston holding mechanism operable to retain the piston in a preselected first position.

4. A free-piston internal combustion engine according to claim 2 further comprising a piston holding mechanism operable to retain the piston in a preselected second position.

5. A free-piston internal combustion engine according to claim 3 further comprising a piston holding mechanism operable to retain the piston in a preselected second position.

6. A free-piston internal combustion engine according to claim 2 further comprising a pressure relief mechanism in communication with the second portion of the cylinder.

7. A free-piston internal combustion engine according to claim 2 further comprising a piston damper operable to decelerate the piston.

8. A free-piston internal combustion engine according to claim 2 further comprising a pressure relief mechanism in communication with the first portion of the cylinder.

9. A free-piston internal combustion engine comprising:

a combustion chamber;

a cylinder in communication with the combustion chamber, the cylinder having a first portion adjacent the combustion chamber and a distal second portion;

a sliding piston in the cylinder, the piston slidable from a first position in the first portion of the cylinder to a second position in the second portion of the cylinder responsive to ignition of a combustible material in the combustion chamber;

the piston sealing engaged with the cylinder and operable between the first and second positions to create a vacuum in the first portion of the cylinder and to pressurize a working fluid in the cylinder; and, a conduit in communication with the first portion of the cylinder and an external work producing apparatus producing work, the apparatus selected from the group comprising a turbine, vacuum pump, evaporator, gas evacuation device, or energy producing device.

10. A free-piston internal combustion engine according to claim 9 comprising the conduit further communication with a work producing apparatus selected from a group comprising a turbine, a motor, an engine, a pump, and compressor.

11. A free-piston internal combustion engine according to claim 9 further comprising a piston holding mechanism operable to retain the piston in the first position.

12. A free-piston internal combustion engine according to claim 9 further comprising a pressure relief mechanism in communication with the second portion of the cylinder.

13. A free-piston internal combustion engine according to claim 9 further comprising a piston damper operable to decelerate the piston.

14. A free-piston internal combustion engine according to claim 9 further comprising a pressure relief mechanism in communication with the first portion of the cylinder.

15. A method for creating and utilizing a vacuum in a cylinder comprising the steps of:

holding a free piston in place at one end of an internal combustion cylinder as an air/fuel mixture is charged to the combustion chamber;

igniting the fuel and releasing the piston;

allowing the free piston to be propelled as far its momentum will carry it so that a vacuum is created in the cylinder behind the piston;

sealing the cylinder so that its vacuum is secured;

allowing air, gas, vapors, or fluids from outside the cylinder to enter the cylinder;

passing the air, gas, vapors, or fluids that enter the cylinder through a device that produces work or energy from the air, gas, vapor, or fluids flowing into the cylinder; and, allowing combustion products to exit the cylinder and the piston to return to its initial position whereby the cylinder's vacuum can be utilized as the basis for allowing an external apparatus to produce work, the apparatus selected from the group comprising a vacuum pump, turbine, evaporator, gas evacuation device, or energy producing device.

16. A method according to claim 15 wherein the step of producing work or energy includes driving an apparatus selected from the group comprising a motor, an engine, a pump, and a compressor.

17. A free piston vacuum producing internal combustion apparatus comprising:

a free piston in an internal combustion cylinder;

a combustion chamber to contain gas at high pressure on one side of the free piston;

a piston holding mechanism to secure the piston in place before fuel ignition;

a device to ignite the fuel/air mixture in the combustion chamber;

a cylinder of sufficient length to allow the combustion gas expansion to propel the piston to a point where a partial vacuum is crated in the cylinder behind the piston;

a means to secure the cylinder's vacuum when the free piston comes to rest after combustion gas expansion;

an entry port for air, gas, vapor, or fluids to enter the cylinder to allow outside air, gas, or vapors to enter the cylinder's vacuum;

a device attached to the entry port that produces work or energy from the air, gas vapor, or fluid that flows into the cylinder's vacuum; and, an exhaust port or ports to allow gasses to exit the cylinder whereby the cylinder's vacuum is utilized as the basis for allowing an external apparatus to produce work, the apparatus selected from the group comprising a vacuum pump, turbine, evaporator, gas evacuation device or energy producing device.

18. The free piston vacuum producing apparatus of claim 17 wherein the step of producing work or energy includes driving an apparatus selected from the group comprising a turbine, a motor, an engine, a pump, and a compressor.

19. The free piston vacuum producing apparatus of claim 17 wherein the piston holding mechanism is a clamp, hook, friction clutch, ratchet and pawls, clip, latch, catch, wedge, rod, or other device for the purpose of holding at suitable times the free piston.

20. The free piston vacuum producing apparatus of claim 17 wherein the energy-absorbing device is a spring, shock absorber, air cushion, or other means to restrain the forward motion of the piston or to store the energy of the moving piston.

21. The free piston vacuum producing apparatus of claim 17 wherein the piston sealing mechanism is a valve, plug, wedge, block, seal, clamp, fastener, obstruction, or other means to prevent gases from outside the cylinder from entering the cylinder.

22. The free piston vacuum producing apparatus of claim 17 wherein a cooling water jacket is used to withdraw heat from the cylinder wall or interior.

23. The free piston vacuum producing apparatus of claim 17 wherein the piston is designed to allow combustion products to flow through it as the piston return to its initial position.

24. The free piston vacuum producing apparatus of claim 17 wherein the air, gas, vapor entering the cylinder goes directly into the cylinder without going through a device to produce work or energy from the gases flowing into the cylinder.

25. The free piston vacuum producing apparatus of claim 17 wherein a portion of the work produced is used to compress the fuel/air mixture that is charged to the combustion chamber.

* * * * *